United States Patent [19]

Stumpf et al.

[11] Patent Number: 4,523,344

[45] Date of Patent: Jun. 18, 1985

[54] INDEPENDENT BLOCK ASSEMBLY OF SPRINGS

[75] Inventors: Walter Stumpf; Paul Dillon, both of Dunwoody, Ga.

[73] Assignee: Simmons U.S.A. Corporation, Atlanta, Ga.

[21] Appl. No.: 419,369

[22] Filed: Sep. 17, 1982

[51] Int. Cl.[3] ..... A47C 27/09

[52] U.S. Cl. ..... 5/477; 5/465; 5/475

[58] Field of Search ..... 5/465, 475, 477

[56] References Cited

U.S. PATENT DOCUMENTS

| | | | |
|---|---|---|---|
| 410,133 | 8/1889 | Blocher . | |
| 681,573 | 8/1901 | Nichols | 5/465 |
| 698,529 | 4/1902 | Marshall . | |
| 831,441 | 9/1906 | Johnson . | |
| 931,361 | 8/1909 | Weinberg | 5/465 |
| 975,695 | 11/1910 | Knuppen . | |
| 1,208,889 | 12/1916 | Anderson et al. | 5/465 |
| 1,284,384 | 11/1918 | Lewis . | |
| 1,287,663 | 12/1918 | Foster . | |
| 1,434,653 | 11/1922 | Fiss et al. . | |
| 1,457,203 | 5/1923 | Wick | 5/465 |
| 1,549,289 | 8/1925 | Bradley | 5/465 |
| 1,560,588 | 11/1925 | Lewis | 5/477 |
| 1,906,893 | 1/1931 | Young et al. . | |
| 3,633,228 | 1/1972 | Milton . | |
| 4,234,984 | 11/1980 | Stumpf | 5/477 |

FOREIGN PATENT DOCUMENTS

| | | | |
|---|---|---|---|
| 20485 | 4/1925 | United Kingdom | 5/465 |

*Primary Examiner*—Gary L. Smith
*Assistant Examiner*—Michael F. Trettel
*Attorney, Agent, or Firm*—A. Thomas Kammer

[57] ABSTRACT

A spring assembly is provided including a plurality of interconnected longitudinal blocks of pocketed coil springs. Each block includes a pair of interconnected strips of pocketed springs which are preferably arranged in a square array. Each pair of strips is tightly encased by a flexible cover. The covers are connected to each other along longitudinal hinge lines which allows the assembly to bend easily in at least one direction.

8 Claims, 7 Drawing Figures

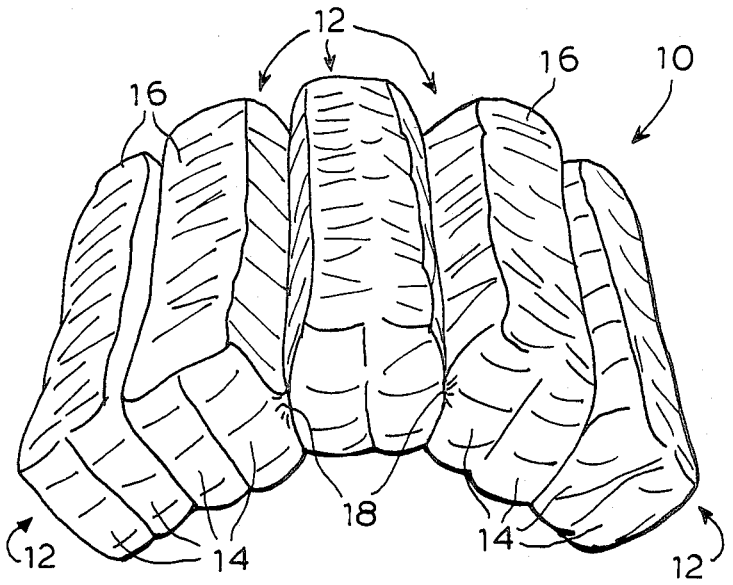
FIG.4
FIG.5
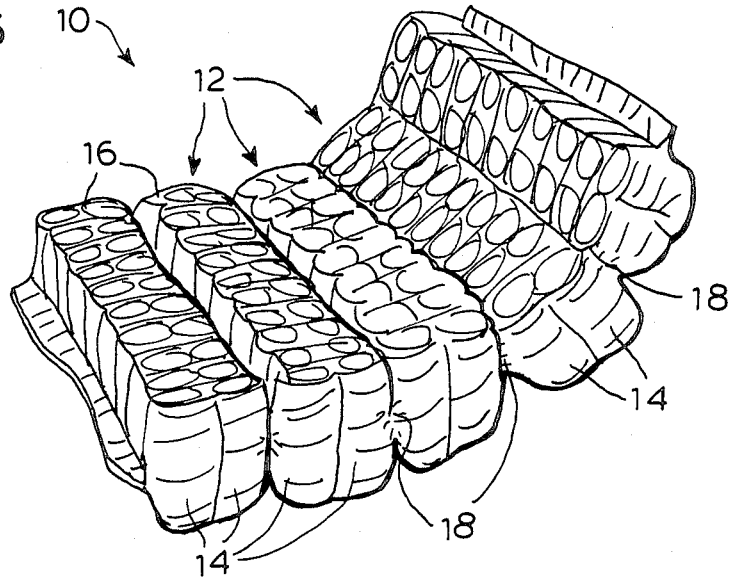

INDEPENDENT BLOCK ASSEMBLY OF SPRINGS

BACKGROUND OF THE INVENTION

1. Field of the Invention

The field of the invention relates to a block assembly of pocketed coil springs for use in a cushion, mattress or other article.

2. Brief Description of the Prior Art

Assemblies of pocketed springs have been used to advantage for a number of years. The springs may be manufactured in strips which comprise the individual rows of coils in a mattress construction. These strips may be assembled in a nested configuration as disclosed by Edward E. Woller in U.S. Pat. No. 2,805,429.

If a square array of pocketed coil springs is desired, a construction as described in U.S. Pat. No. 4,234,984 may be utilized. This patent is incorporated by reference herein. It discloses an arrangement of thermally welded pocketed coils wherein adjacent strips are connected to each other at every other seam between the coils.

SUMMARY OF THE INVENTION

An assembly of pocketed coil springs is provided which includes a plurality of rows of independent longitudinal blocks of said springs. Each block includes a plurality of rows or strips of pocketed springs affixed to each other in a preferably square array. A flexible fabric cover defines the exterior surface of each block and substantially encloses the connected strips of pocketed coils therein. Each block is connected to its adjacent blocks by respective switch or weld lines along its longitudinal sides. The strips of pocketed springs within each block are not directly connected to those in adjacent blocks. The outside fabric covers are instead connected thereby allowing the springs within each block to act at least somewhat independently of springs within the other blocks. Depending upon the means by which the blocks are connected to each other, the springs in adjacent blocks may act very substantially independently of each other.

It has been found that if the blocks are connected along the upper or lower edges thereof, an assembly having two firmnesses is provided. In other words, the assembly will be firmer when exerting pressure on the side where the connections are made than the opposite side. If connections are made along the respective longitudinal center lines of the blocks, the two sides will be of equal firmness.

An advantage of the block assembly according to the invention is its flexibility. The edge-connected construction is easily bendable in one direction and could even be folded in half. Two-way bending is possible with the connected center line construction although the extent thereof is more limited. Both embodiments have great utility where mattress flexibility is an important consideration. Adjustable beds for both home and hospital use would be suitable applications for the invention.

BRIEF DESCRIPTION OF THE DRAWINGS

FIG. 4 is a perspective view of the spring block assembly shown in FIG. 2;

FIG. 5 is a perspective view of the assembly shown in FIG. 4 bending in the opposite direction;

DETAILED DESCRIPTION OF THE INVENTION

A spring block assembly 10,10' is provided which includes a plurality of rows of independent longitudinal blocks 12,12' of pocketed coil springs 14,14'. Two strips of pocketed springs are within each block 12. The strips are preferably connected to each other in the manner described in U.S. Pat. No. 4,234,984 to provide a "square" array of springs. If desired, more than two strips may be incorporated within a particular block. The use of two, however, allows both sufficient flexibility and a "square" array.

Figure 2:
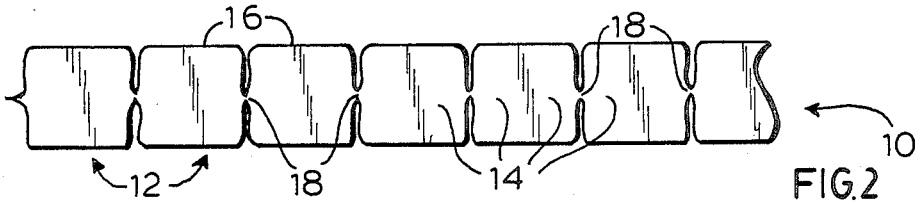
FIG. 2 is a side elevation view of a spring block assembly according to the invention.

The interconnected strips are each substantially enveloped by a fabric cover 16 of natural or synthetic material. The cover is tightly wrapped about the springs and may even compress them slightly. In the embodiment shown in FIGS. 2 and 4–5, a pair of fabric sheets are placed above and below a plurality of parallel rows of interconnected strips. As discussed above, each block includes a pair of rows of interconnected pocketed springs. The two sheets are then stitched or thermally welded (depending upon the material employed) along connection lines 18 between the upper and lower edges of adjacent blocks 12. In the embodiment shown, these lines are midway between the edges creating what shall be referred to as a center hinge assembly. As shown in FIGS. 4 and 5, two way bending is possible with such a construction.

Figure 3:
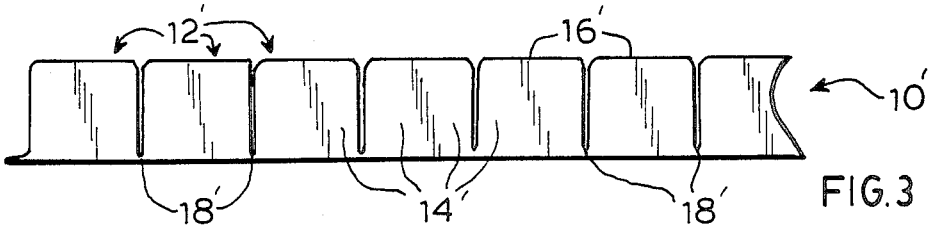
FIG. 3 is a side elevation view of a spring block assembly according to a second embodiment of the invention.
Figure 6:
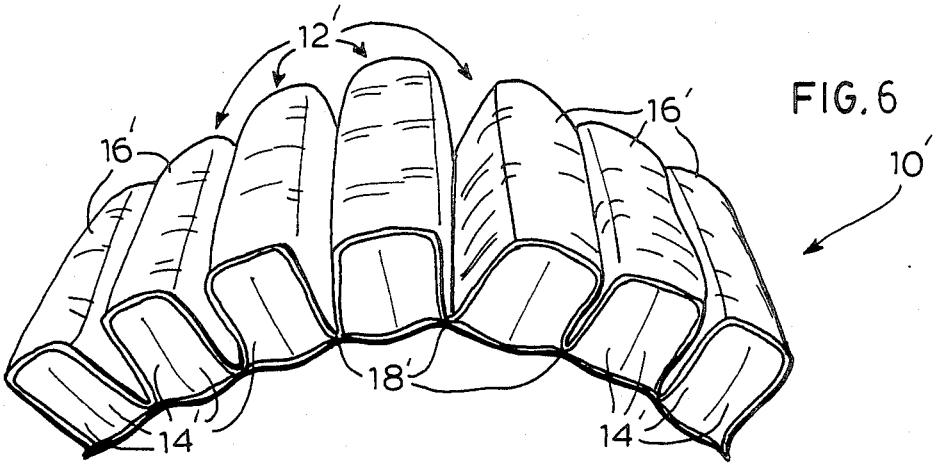
FIG. 6 is a top perspective view of the spring block assembly shown in FIG. 3.
Figure 7:
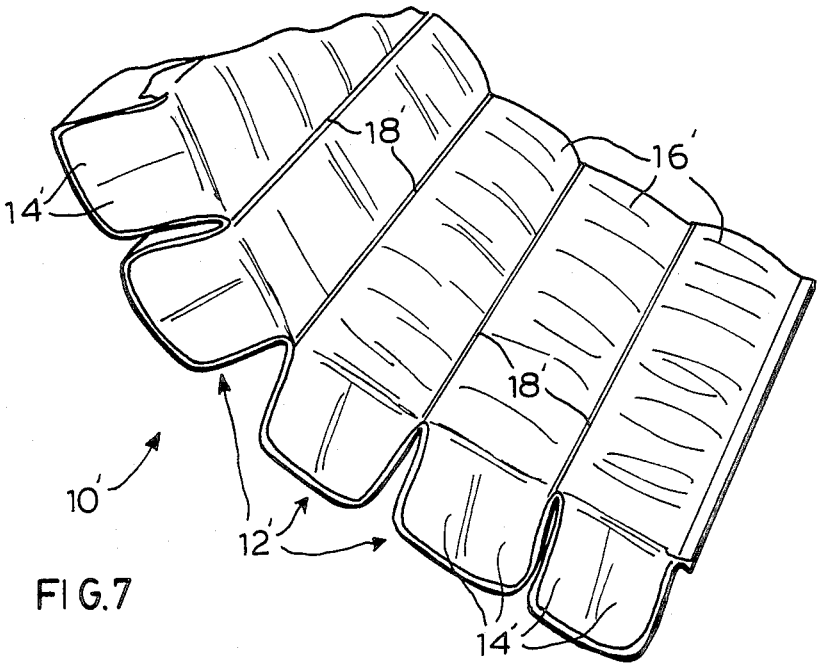
FIG. 7 is a bottom perspective view thereof.

In the embodiment shown in FIGS. 3, 6, and 7, the two cover sheets comprising cover 16' are secured along connection lines 18' near the edges of the respective blocks 12' resulting in a top or bottom hinge assembly. Bending of the assembly 10' is possible only in the direction shown, but it is apparent that it can even overlap itself if necessary. This construction is particularly useful in sofa beds where a folded mattress would facilitate storage. It is also advantageous within a cushion or mattress if different firmnesses are desired for the top and bottom surfaces thereof. If a bottom hinge assembly is employed, the bottom surface will have greater firmness than the top surface. Both embodiments are characterized by connection lines lying in planes substantially perpendicular to the coil springs.

The fabric cover 16 need not be made from large contiguous sheets. If the dimensions of a mattress to be made according to the invention exceed the length or width of the sheet, two sheets may be connected end to end or side to side. Alternatively, each of the longitudinal blocks may be manufactured individually with the fabric cover sheets overlapping each other to form flanges. These flanges may then be interconnected.

Figure 1:
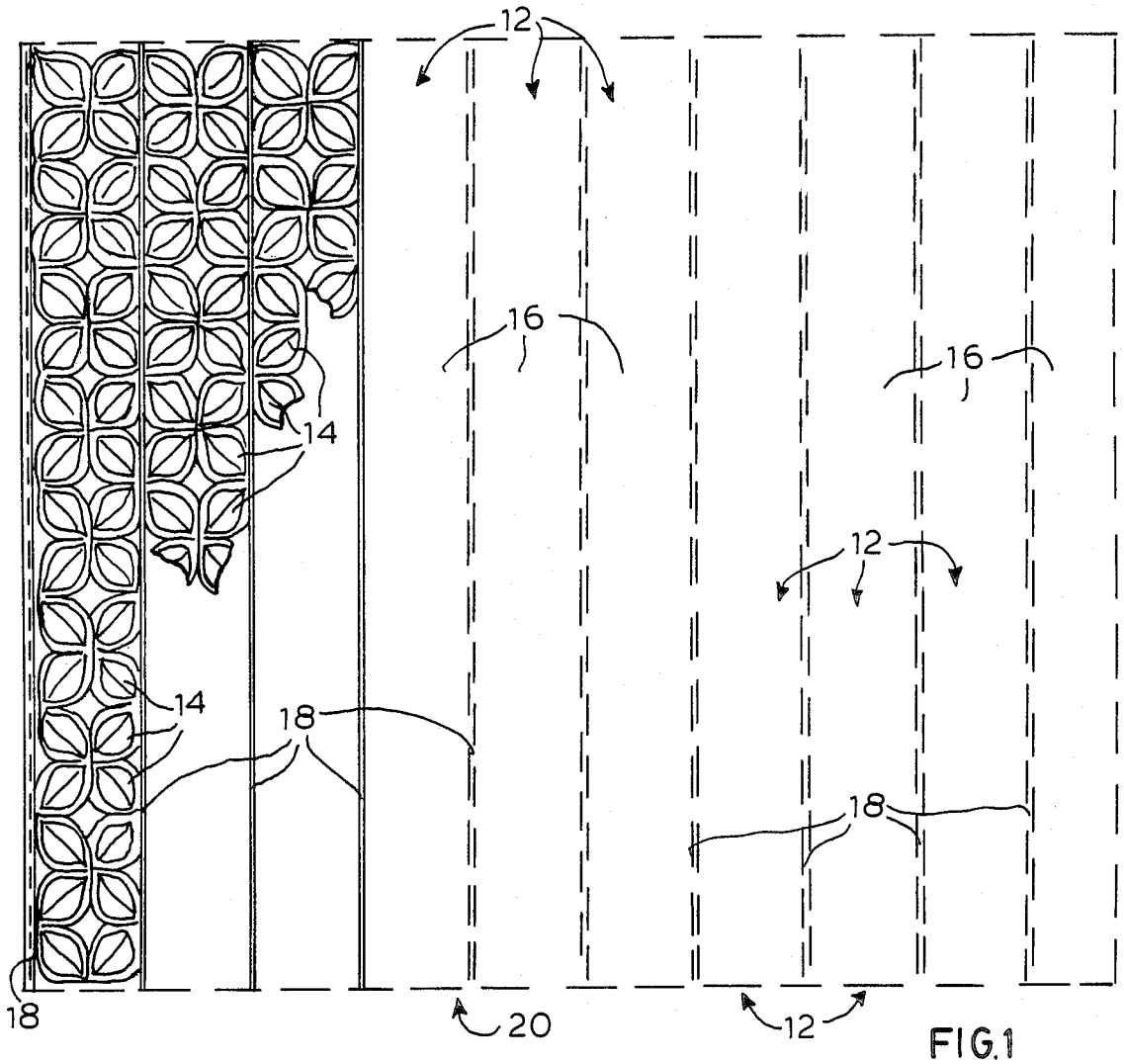
FIG. 1 is a partially cutaway plan view of a mattress according to the invention.

FIG. 1 illustrates a mattress 20 made in accordance with the invention. It will be noted that its appearance is similar to that shown in FIG. 1 of U.S. Pat. No. 4,234,984 with respect to the orientation of the pocketed coil springs. Border wires may be added for peripheral support.

The connecting lines 18,18', whether stitched or welded may be all of one type (e.g. center hinge) or a combination of types. If bending in two directions is necessary for the entire structure, it should be entirely of center hinge construction. If one portion (e.g. the head) needs only to be angled in one direction (e.g. up) from the horizontal plane, one or more top hinge connections may be employed where necessary. As discussed above, the firmness of the resulting structure is influenced by the location of the connecting lines. If a mattress having two sides of distinctly different firmnesses is required, it should be entirely constructed from top or bottom hinged blocks. The terms top and bottom are relative with respect to the orientation of the mattress and may be used interchangeably herein.

It has been found that the block design according to the invention gives superior body support. Roller tests indicate improved resistance to depression. Other advantages will become apparent as the invention is applied to different uses.

What is claimed is:

1. A flexible spring assembly comprising a plurality of interconnected parallel blocks having respective top and bottom surfaces, each of said blocks including first and second substantially parallel strips of interconnected pocketed coil springs, said strips each being defined by a plurality of coil springs encased between plies of a fabric strip, said plies being attached to each other between each coil spring to define individual compartments for each spring, said strips being connected to each other so as to form a non-nested arrangement of said pocketed springs, and a flexible cover wrapped about and tightly encasing said connected strips; said blocks being hingedly attached to each other by longitudinal lines of connection connecting adjacent flexible covers to each other, said lines of connection being in a plane substantially perpendicular to the axes of each of said coil springs of an adjacent block; there being no connections between said blocks other than said longitudinal lines of connection.

2. A spring assembly as defined in claim 1 wherein said lines of connection are between the respective top and bottom surfaces of said longitudinal blocks.

3. A spring assembly as defined in claim 2 wherein said lines of connection are midway between the respective top and bottom surfaces of said longitudinal blocks.

4. A spring assembly as defined in claim 1 wherein said lines of connection are adjacent the respective bottom surfaces of said longitudinal blocks.

5. A spring assembly as defined in claim 1 including at least one line of connection between the top and bottom surfaces of one of said longitudinal blocks and another line of connection adjacent the bottom surface thereof.

6. A spring assembly as defined in claim 1 wherein each block includes only two strips.

7. A spring assembly as defined in claim 1 wherein said covers are defined by first and second sheets of flexible material defining the top and bottom surfaces of said blocks, said sheets being connected to each other along lines between each of said blocks.

8. A spring assembly as defined in claim 1 wherein each of said flexible covers slightly compresses the pocketed coil springs contained therein.

* * * * *